US007017553B2

(12) United States Patent
Boehland

(10) Patent No.: US 7,017,553 B2
(45) Date of Patent: Mar. 28, 2006

(54) FUEL INJECTION DEVICE FOR AN INTERNAL COMBUSTION ENGINE

(75) Inventor: Peter Boehland, Marbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/508,256

(22) PCT Filed: Feb. 25, 2003

(86) PCT No.: PCT/DE03/00586

§ 371 (c)(1),
(2), (4) Date: Sep. 20, 2004

(87) PCT Pub. No.: WO2004/016938

PCT Pub. Date: Feb. 26, 2004

(65) Prior Publication Data

US 2005/0178362 A1 Aug. 18, 2005

(30) Foreign Application Priority Data

Jul. 20, 2002 (DE) ..... 102 33 099

(51) Int. Cl.
*F02M 55/00* (2006.01)

(52) U.S. Cl. ..... 123/446; 123/447; 123/506

(58) Field of Classification Search ..... 123/446, 123/447, 506, 500–502
See application file for complete search history.

(56) References Cited

U.S. PATENT DOCUMENTS

| | | | | |
|---|---|---|---|---|
| 4,146,178 | A * | 3/1979 | Bailey | 239/90 |
| 4,281,792 | A * | 8/1981 | Sisson et al. | 239/5 |
| 4,327,694 | A * | 5/1982 | Henson et al. | 123/500 |
| 4,393,847 | A * | 7/1983 | May | 123/502 |
| 4,437,443 | A * | 3/1984 | Hofbauer | 123/446 |
| 4,811,899 | A * | 3/1989 | Egler | 239/5 |
| 5,566,660 | A * | 10/1996 | Camplin et al. | 123/496 |
| 6,267,306 | B1 * | 7/2001 | Phillips et al. | 239/585.1 |
| 6,886,535 | B1 * | 5/2005 | Boehland | 123/446 |

* cited by examiner

*Primary Examiner*—Thomas Moulis
(74) *Attorney, Agent, or Firm*—Ronald E. Greigg

(57) ABSTRACT

A fuel injection apparatus having a high-pressure fuel pump and a fuel injection valve for each cylinder of an internal combustion engine, in which fuel pump has two pump pistons driven by the engine and delimiting a pump working chamber supplied with fuel from a tank. The second pump piston is guided to slide inside the first pump piston. The two pistons can be coupled so that they move as a unit during the delivery stroke or the second can be fixed in a passive position so that only the first executes a delivery stroke. The fuel injection valve a second injection valve element which is guided to slide inside a first injection valve element can be acted on by the pressure prevailing in a control pressure chamber which has a connection to the pump working chamber controlled by the second pump piston wherein the control pressure chamber is disconnected from the pump working chamber when the second pump piston is disposed in its passive position.

20 Claims, 8 Drawing Sheets

FUEL INJECTION DEVICE FOR AN INTERNAL COMBUSTION ENGINE

CROSS-REFERENCE TO RELATED APPLICATIONS

This application is a 35 USC 371 application of PCT/DE 03/00586 filed on Feb. 25, 2003.

BACKGROUND OF THE INVENTION

1. Field of the Invention

The invention is directed to an improved fuel injection apparatus for an internal combustion engine of the type having a high pressure fuel pump and a fuel injection valve for each cylinder of the engine.

2. Description of the Prior Art

A fuel injection apparatus of the type with which this invention is concerned is known from European Patent 0 987 431 A2. This fuel injection apparatus has a high-pressure fuel pump and a fuel injection valve for each cylinder of the internal combustion engine. The high-pressure fuel pump has a pump piston that is driven into a stroke motion by the engine and that delimits a pump working chamber. The fuel injection valve has a pressure chamber connected to the pump working chamber and an injection valve element that controls at least one injection opening and, actuated by the pressure prevailing in the pressure chamber, can be moved in the opening direction counter to a closing force in order to open the at least one injection opening. A control valve is provided that controls a connection of the pump working chamber to a relief to chamber and a pressure source. When the control valve is open, the pump working chamber is filled with fuel from the pressure source during the intake stroke of the pump piston. It is desirable for the high-pressure pump to produce a high-pressure even at low speeds of the engine, permitting a high output and powerful torque of the engine to be achieved. The pressure produced by the high-pressure pump, however, increases with the speed of the engine; the maximum pressure produced must be limited in order to assure a sufficient service life of the high-pressure pump. A design compromise must therefore be struck between a specified drive unit of the high-pressure pump and a specified diameter of the pump piston in order on the one hand to achieve a sufficiently high pressure at a low engine speed and on the other hand not to exceed the maximum pressure that has been specified for reasons related to the service life. The injection valve element of the fuel injection valve controls an injection cross-section that is always the same size. This does not permit an optimal fuel injection under all operating conditions of the internal combustion engine.

SUMMARY AND ADVANTAGES OF THE INVENTION

The fuel injection apparatus according to the invention has the advantage over the prior art that the pressure produced by the high-pressure pump can be limited by bringing the second pump piston into its passive position and delivering fuel with only the first pump piston. At low speeds of the engine, the two pump pistons can be coupled to each other and can execute a delivery stroke, while at high speeds, the second pump piston is brought into its passive position and only the first pump piston executes a delivery stroke, thus reducing the pressure produced. The first pump piston can be embodied with a large enough diameter for a high pressure to be produced even at a low engine speed. The fuel injection apparatus according to the invention also offers the advantage that the second injection valve element can open or close additional injection cross-section by means of the at least one second injection opening, thus making it possible to optimally adapt the injection cross-section to the operating conditions of the engine. The injection cross-section is simply controlled by means of the second pump piston, thus requiring no additional expense.

Advantageous embodiments and modifications of the fuel injection apparatus according to the invention are disclosed. One embodiment makes it possible to increase the opening pressure of the second injection valve element when the second pump piston is disposed in its passive position. Another embodiment makes it possible to reduce the opening pressure of the second injection valve when the second pump piston is disposed in its passive position. A further embodiment makes it possible to bring the second pump piston into its passive position in an advantageous way, while another facilitates manufacture of the first pump piston, and another permits a pressure compensation between the pump working chamber and the chamber in the first pump piston in the event of a leak. According to another embodiment it is assured that when the pump pistons are coupled to each other, fuel cannot escape from the pump working chamber via the through bore in the second pump piston while a further embodiment assures a contact of the second pump piston against the boundary of the pump working chamber in the region of the inner dead center of the pump piston. One feature assures that when the second pump piston is disposed in its passive position during the delivery stroke of the first pump piston, fuel cannot escape from the pump working chamber via the through bore in the second pump piston, while another achieves a pressure compensation between the through bore in the second pump piston and the pump working chamber in the region of the inner dead center of the pump piston. A reliable contact of the second pump piston against the boundary can be achieved, while making it easy to bring the second pump piston into its passive position.

BRIEF DESCRIPTION OF THE DRAWINGS

A number of exemplary embodiments of the invention are more fully described herein below, in conjunction with the drawings, in which.

DESCRIPTION OF THE PREFERRED EMBODIMENT

Figure 1:
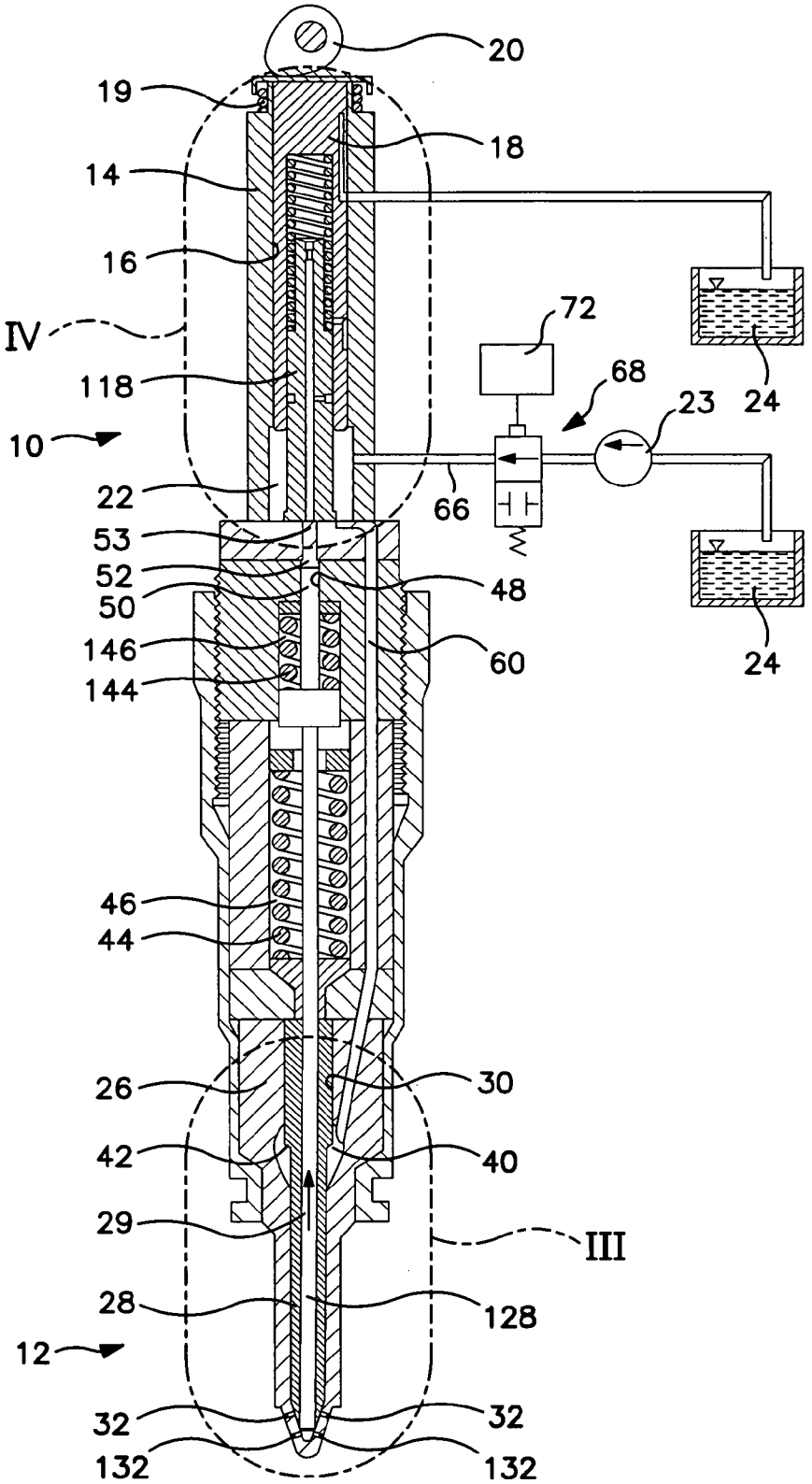
FIG. 1 shows a schematic, longitudinal section through a fuel injection apparatus for an internal combustion engine according to a first exemplary embodiment of the invention.

FIGS. 1 to 7 show a fuel injection apparatus for an internal combustion engine of a motor vehicle. The engine is preferably an autoignition engine. The fuel injection apparatus is preferably embodied as a so-called unit injector and for each cylinder of the engine, has a respective high-pressure fuel pump 10 and a fuel injection valve 12 connected to it, which constitute a combined unit. Alternatively, the fuel injection apparatus can also be embodied as a so-called unit pump system in which the high-pressure fuel pump and the fuel injection valve of each cylinder are disposed separately from each other and are connected by means of a line. The high-pressure fuel pump 10 has a pump body 14 with a cylinder bore 16 that contains two pump pistons 18, 118; a first pump piston 18 with a large diameter is guided in a sealed fashion in the cylinder bore 16 and is driven at least indirectly into a stroke motion by a cam 20 of a camshaft of the engine, counter to the force of a return spring 19. A second pump piston 118 is disposed inside the first pump piston 18, at least approximately coaxial to it. The pump pistons 18, 118 will be described in further detail below. In the cylinder bore 16, the end surfaces of the two pump pistons 18, 118 delimit a pump working chamber 22 in which fuel is compressed at a high pressure during the delivery stroke of the pump pistons 18, 118. The pump working chamber 22 is supplied with fuel from a fuel tank 24 of the motor vehicle by means of a pressure source, which is preferably a fuel supply pump 23.

Connected to the pump body 14, the fuel injection valve 12 has a valve body 26, which can be comprised of multiple parts and contains a first injection valve element 28 that can slide longitudinally in a bore 30. In its end region oriented toward the combustion chamber in the cylinder of the engine, the valve body 26 has at least one, preferably several, first injection openings 32. In its end region oriented toward the combustion chamber, the first injection valve element 28 has a for example approximately conical sealing surface 34, which cooperates with a first valve seat 36 provided in the end region of the valve body 26 oriented toward the combustion chamber; the first injection openings 32 branch off from this first valve seat 36 or branch off downstream of it. Between the first injection valve element 28 and the bore 30 toward the first valve seat 36, the valve body 26 contains an annular chamber 38, which, in its end region oriented away from the first valve seat 36, transitions via a radial enlargement of the bore 30 into a pressure chamber 40 encompassing the first injection valve element 28. At the level of the pressure chamber 40, the first injection valve element 28 has a pressure shoulder 42 formed by a cross-sectional reduction. The end of the first injection valve element 28 oriented away from the combustion chamber is engaged by a prestressed first closing spring 44 that presses the first injection valve element 28 toward the first valve seat 36. The first closing spring 44 is disposed in a first spring chamber 46 of the valve body 26, adjoining the bore 30.

Figure 3:
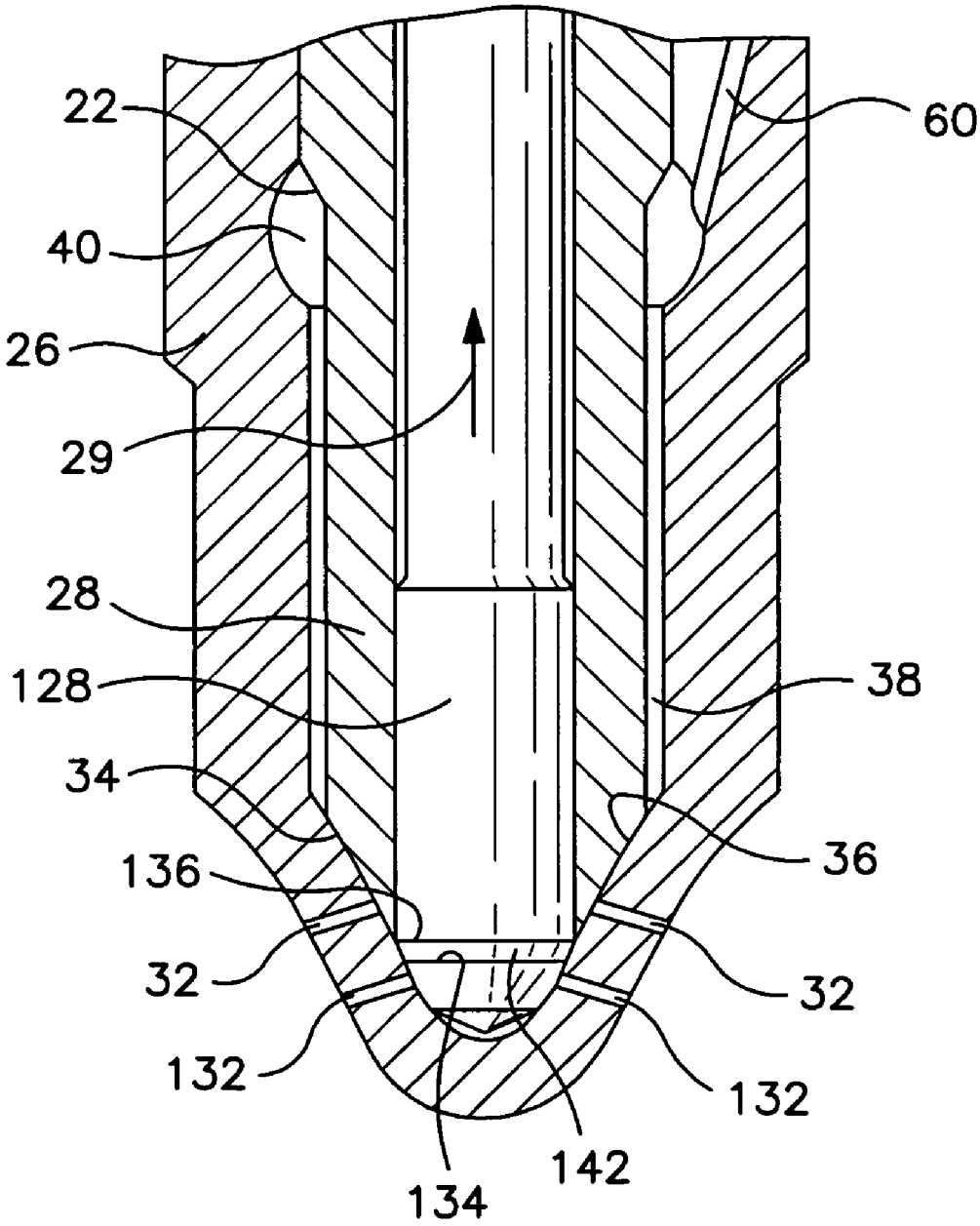
FIG. 3 shows an enlargement of a detail labeled III in FIG. 1.

The first injection valve element 28 of the fuel injection valve 12 is embodied as hollow, as shown in FIG. 3, and a second injection valve element 128 is guided in a sliding fashion in a coaxial bore provided inside the first injection valve element 28. The second injection valve element 128 controls at least one, preferably several, second injection openings 132 in the valve body 26. In relation to the first injection openings 32, the second injection openings 132 are disposed offset toward the combustion chamber in the direction of the longitudinal axis of the injection valve elements 28, 128. In its end region oriented toward the combustion chamber, the second injection valve element 128 has a for example approximately conical sealing surface 134 that cooperates with a second valve seat 136 embodied in the end region of the valve body 26 oriented toward the combustion chamber; the second injection openings 132 branch off from this second valve seat 136 or branch off downstream of it. The second injection valve element 128 extends through the first spring chamber 46 and protrudes into a second spring chamber 146 adjoining the first spring chamber 46. A second closing spring 144, which is clamped between the bottom of the second spring chamber 146 and the second injection valve element 128, acts on the second injection valve element 128 in a closing direction toward the second valve seat 136. Close to its combustion chamber end, the second injection valve element 128 is provided with a pressure surface 142 that is acted on in the opening direction 29 by the pressure prevailing in the pressure chamber 40 when the first injection valve element 28 is open.

FIG. 1 shows the fuel injection apparatus according to a first exemplary embodiment in which the end of the second spring chamber 146 oriented away from the first spring chamber 46 is adjoined by a bore 48, which is smaller in diameter than the second spring chamber 146 and which contains a control piston 50 that is guided in a sealed fashion and is connected to the second injection valve element 128. Inside the bore 48, the control piston 50 delimits a control pressure chamber 52 that has a connection 53 to the pump working chamber 22. The connection 53 of the control pressure chamber 52 feeds into the pump working chamber 22 at least approximately coaxial to the cylinder bore 16. The pressure prevailing in the control pressure chamber 52 acts on the control piston 50 and by means of it, acts on the second injection valve element 128 in a closing direction oriented toward the second valve seat 136. The pressure prevailing in the control pressure chamber 52 therefore acts in concert with the second closing spring 144.

Figure 2:
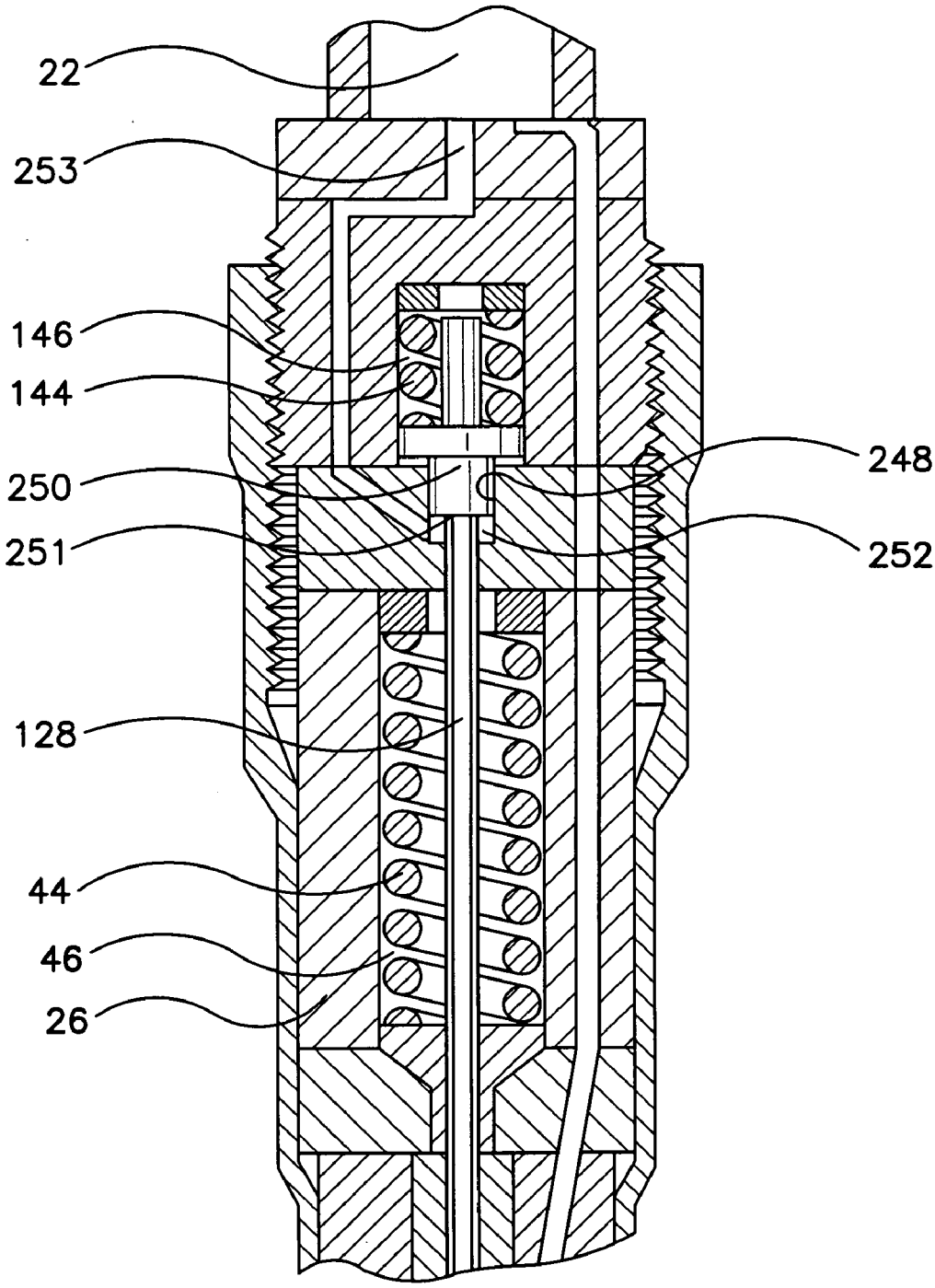
FIG. 2 shows a detail of the fuel injection apparatus according to a second exemplary embodiment.

In a second exemplary embodiment of the fuel injection apparatus shown in FIG. 2, the second injection valve element 128 is adjoined by a control piston 250 connected to it, whose end oriented away from the second injection valve element 128 protrudes into a second spring chamber 146. A second closing spring 144, which is clamped between the bottom of the second spring chamber 146 and the control piston 250, acts on the second injection valve element 128 via the control piston 250 in a closing direction toward the second valve seat 136. Between the first spring chamber 46 and the second spring chamber 146, a bore 248 is provided, which has a smaller diameter than the spring chambers, and the control piston 250 is guided in a sealed fashion inside this bore. The bore 248 and the control piston 250 are embodied as correspondingly stepped in diameter; they have a larger diameter in their respective sections oriented toward the second spring chamber 146 than at their ends oriented toward the first spring chamber 46. The stepped diameter provides the control piston 250 with an annular shoulder 251 that delimits an annular chamber 252 inside the bore 248, which chamber constitutes a control pressure chamber. The control pressure chamber 252 has a connection 253 to the pump working chamber 22 that feeds into the pump working chamber 22 at least approximately coaxial to the cylinder bore 16. The pressure prevailing in the control pressure chamber 252 acts on the control piston 250 and therefore on the second injection valve element 128 with a force that is oriented in the opening direction 29 and acts in opposition to the force of the second closing spring 144.

Leading from the pump working chamber 22, a conduit 60 extends through the pump body 14 and the valve body 26 to the pressure chamber 40 of the fuel injection valve 12. Starting from the pump working chamber 22 or from the conduit 60, a connection 66 leads to a relief chamber, which function can be at least indirectly fulfilled by the fuel tank 24 or the pressure side of the fuel supply pump 23, and from there, to the fuel supply pump 23. An electrically actuated control valve 68 controls the connection 66. The control valve 68 can be embodied as a 2/2-way valve. The control valve 68 can have an electromagnetic actuator or a piezoelectric actuator and is triggered by an electronic control unit 72.

The design of the high-pressure fuel pump 10 with the two pump pistons 18, 118 will be described in detail below in conjunction with FIGS. 4 to 7. The first pump piston 18 has blind bore 80 extending at least approximately coaxially inside it, which is open toward the end of the pump piston 18 that delimits the pump working chamber 22. The mouth of the blind bore 80 on the end surface of the first pump piston 18 has a for example at least approximately conical bevel 81 that enlarges the diameter of the blind bore 80. Close to the bottom 82 of the blind bore 80, the first pump piston 18 has a cross bore 83 that connects the blind bore 80 to a longitudinal groove 84, which is let into the outer circumference surface of the pump piston 18 and extends in the longitudinal direction. From the cross bore 83, the longitudinal groove 84 extends both toward the pump working chamber 22 and away from it. The first pump piston 18 also has another cross bore 85 in the middle region of its longitudinal span, which connects the blind bore 80 to another longitudinal groove 86 let into the circumference surface of the pump piston 18. The longitudinal groove 86 extends from the cross bore 85 toward the pump working chamber 22. The cylinder bore 16 is provided with a cross bore 87, which is connected to a low-pressure region and communicates with the longitudinal groove 84 of the first pump piston 18 over the entire stroke motion of the pump piston 18. For example, at least approximately atmospheric pressure prevails in the low-pressure region. In its end region that contains the pump working chamber 22, the cylinder bore 16 has a section 116 with a diameter slightly larger than its remaining region in which the first pump piston 18 is guided in a sealed fashion. The cylinder bore 16—and therefore the pump working chamber 22 contained in it—has a boundary 17, which extends at least approximately perpendicular to the longitudinal axis of the first pump piston 18 and is disposed opposite from the end surface of the pump piston 18 that delimits the pump working chamber 22.

The second pump piston 118 is guided so that it can slide in the blind bore 80 of the first pump piston 18 and protrudes out from the blind bore 80 with its end that delimits the pump working chamber 22. On its end protruding from the blind bore 80, the second pump piston 118 has a section 150 with an enlarged diameter, which has an annular shoulder 151 oriented toward the first pump piston 18. The second pump piston 118 has a through conduit 180 extending in its longitudinal direction, which can be embodied as a through bore, that extends from the end surface that delimits the pump working chamber 22 to the end surface of the second pump piston 118 oriented toward the bottom 82 of the blind bore 80 in the first pump piston 18. The through bore 180 of the second pump piston 118 contains a throttle restriction 181. The end surface of the second pump piston 118 oriented toward the boundary 17 of the pump working chamber 22 is conically beveled so that it is recessed as it extends radially inward toward the mouth of the through bore 180. This provides the end surface of the second pump piston 118 with an annular edge along its radially outer rim, which constitutes a sealing surface 152.

At its end disposed inside the blind bore 80, the second pump piston 118 has a section 154 with a reduced diameter. At the transition of the second pump piston 118 from its full diameter to this section 154, an annular shoulder 155 is formed, which is oriented toward the bottom 82 of the blind bore 80. Inside the blind bore 80, the second pump piston 118 delimits a chamber 153, which is connected to the low-pressure region via the cross bore 83 in the first pump piston 18. The end surface of the second pump piston 118 oriented toward the bottom 82 of the blind bore 80 is conically beveled so that it is recessed as it extends radially inward toward the mouth of the through bore 180. This provides the end surface of the second pump piston 118 with an annular edge along its radially outer rim, which constitutes a sealing surface 156. A spring 158, which is embodied for example as a helical compression spring that encompasses the section 154 of the second pump piston 118, is clamped between the bottom 82 of the blind bore 80 and the annular shoulder 155 of the second pump piston 118. A middle region of the second pump piston 118, viewed in its longitudinal direction, is provided with a cross bore 160, which connects the through bore 180 to an annular groove 161 let into the outer circumference surface of the second pump piston 118. The second pump piston 118 is guided in a sealed fashion with a slight amount of play in the blind bore 80 of the first pump piston 18, at least in its region between the cross bore 160 and the section 150 that protrudes from the blind bore 80. Preferably, the second pump piston 118 is also guided in a sealed fashion with a slight amount of play in the blind bore 80 in a part of the region between the cross bore 160 and the annular shoulder 155.

As explained above in conjunction with the exemplary embodiments according to FIGS. 1 and 2, the connection 53 or 253 of the control pressure chamber 52 or 252 feeds into the pump working chamber 22 approximately coaxial to the pump pistons 18, 118.

Figure 4:
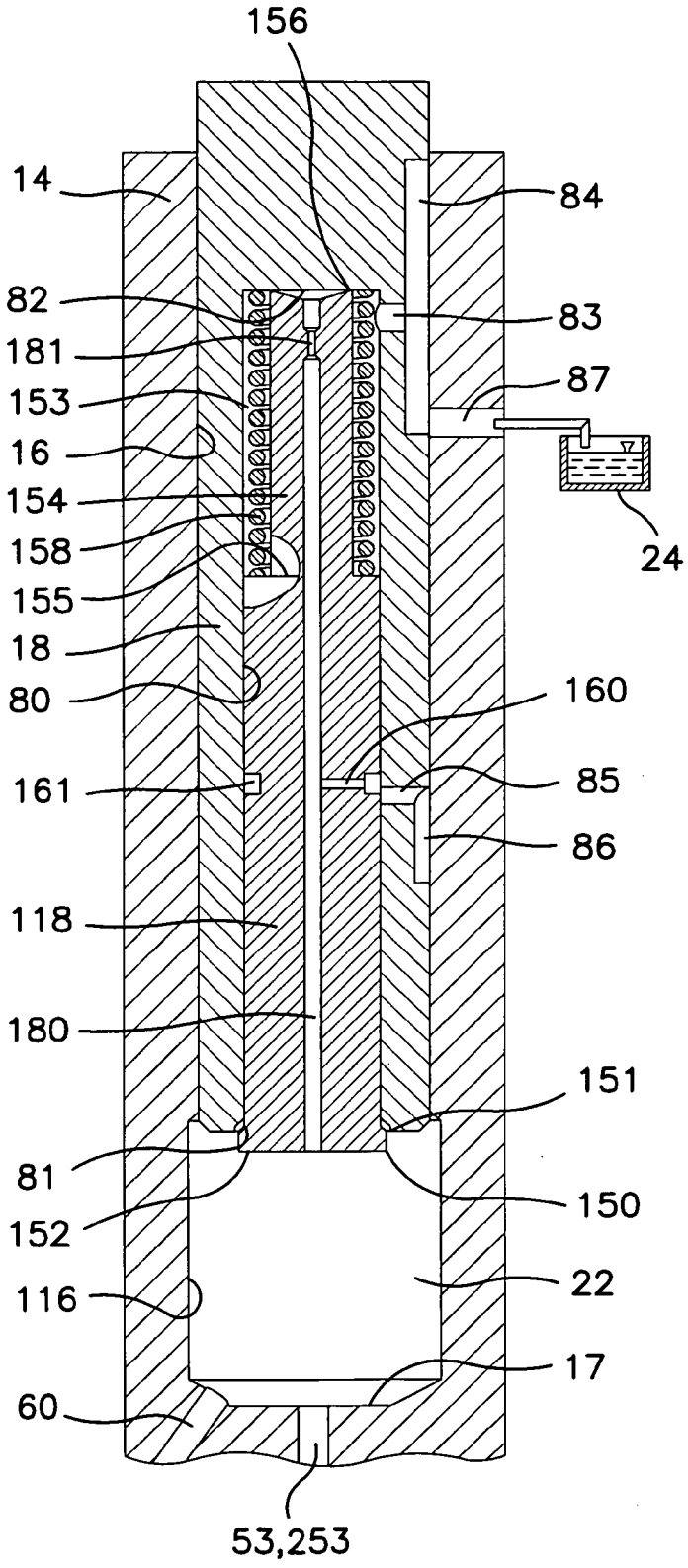
FIG. 4 shows an enlargement of a detail of the fuel injection apparatus labeled IV in FIG. 1, with two pump pistons in a coupled state, in an outer dead center.
Figure 5:
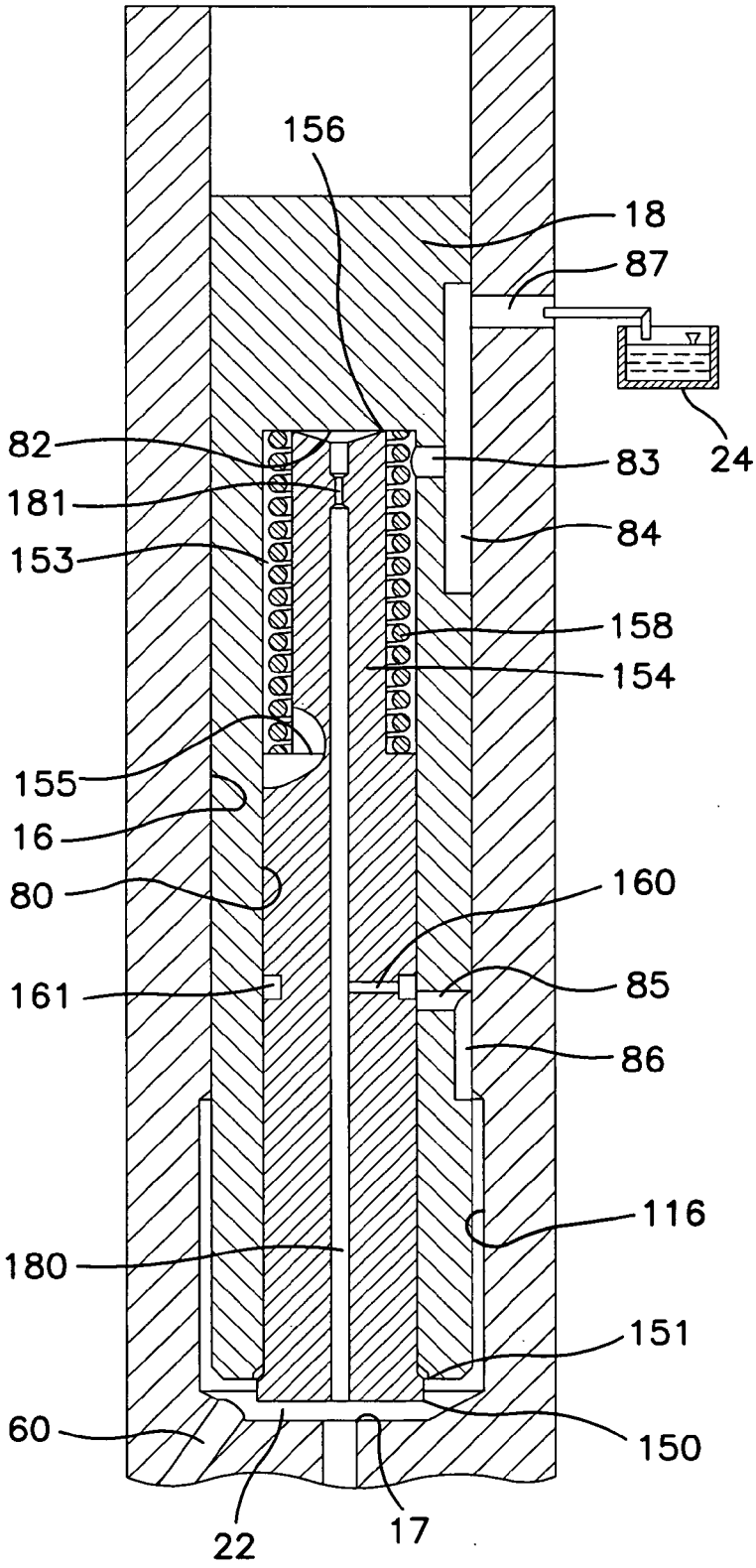
FIG. 5 shows the detail IV, with the pump pistons in an inner dead center.

The two pump pistons 18, 118 in the high-pressure fuel pump 10 can be coupled to each other and can execute a delivery stroke as a unit. During the delivery stroke, the pump pistons 18, 118 move starting from an outer dead center, in which they protrude the farthest from the cylinder bore 16 as shown in FIG. 4, to an inner dead center, in which they plunge the farthest into the cylinder bore 16, as shown in FIG. 5. If the two pump pistons 18, 118 are coupled to each other, then the second pump piston 118 plunges into the blind bore 80 of the first pump piston 18 until it rests with its sealing surface 156 against the bottom 82 of the blind bore 80, as shown in FIGS. 4 and 5. In this position of the second pump piston 118, its annular groove 161 coincides with the cross bore 85 of the first pump piston 18 and the spring 158 is compressed to its shortest length. The pressure prevailing in the pump working chamber 22 acts on the end surface of the second pump piston 118 and exerts a compressive force on it, which presses the sealing surface 156 of the second pump piston 118 against the bottom 82 of the blind bore 80 counter to the force of the spring 158 and counter to the low pressure prevailing in the chamber 153. The sealing surface 156 disconnects the through bore 180 of the second pump piston 118 from the chamber 153 and therefore from the low-pressure region so that fuel cannot escape from the pump working chamber 22 via the through bore 180. If, however, a leak occurs between the sealing surface 156 and the bottom 82, then a small quantity of fuel can flow through the through bore 80 in the second pump piston 118 into the chamber 153 and into the low-pressure region, but the flow is limited by the throttle restriction 181. During the delivery stroke of the pump pistons 18, 118, the entire end surface of the pump pistons, i.e. the annular end surface of the first pump piston 18 and the end surface of the second pump piston 118 disposed inside it, is effective for the production of pressure in the pump working chamber 22 so that a high pressure is produced in the pump working chamber 22. The pump pistons 18, 118 continue to produce high pressure in the pump working chamber 22 as long as the control valve 68 is closed and the pump working chamber 22 is disconnected from the relief chamber 24 and the fuel supply pump 23.

When the pump pistons 18, 118 are disposed in the inner dead center according to FIG. 5, the longitudinal groove 86 of the first pump piston 18 plunges into the section 116 of the cylinder bore 16 so that the through bore 180 in the second pump piston 118 communicates with the pump working chamber 22 via the longitudinal groove 86 and cross bore 85 in the first pump piston 18 and via the annular groove 161 and cross bore 160 in the second pump piston 118. During the subsequent intake stroke of the pump pistons 18, 118, these move away from their inner dead center toward their outer dead center. The control valve 68 is opened so that fuel flows into the pump working chamber 22 at the pressure produced in the fuel supply pump 23. Depending on the speed of the engine and therefore the speed with which the pump pistons 18, 118 move starting from their inner dead center during the intake stroke, the pressure in the pump working chamber 22 drops in comparison to the pressure produced by the fuel supply pump 23 to a pressure lower than the supply pump pressure. During its intake stroke, the first pump piston 18 moves at a predetermined speed, driven by the force of the return spring 19 as a function of the shape of the cam 20. During the intake stroke, the action of the pressure in the pump working chamber 22 on the end surface of the second pump piston 118 causes it to also move away from the inner dead center if the force exerted on the second pump piston 118 by the pressure prevailing in the pump working chamber 22 is greater than the force counteracting it, i.e. the sum of the force of the spring 158 and the force exerted on the second pump piston 118 by the low pressure prevailing in the chamber 153. The second pump piston 118 moves away from the inner dead center during the intake stroke and at the latest, its sealing surface 156 comes into contact with the bottom 82 of the blind bore 80 in the first pump piston 18 when it reaches the outer dead center. During the subsequent delivery stroke, the pump pistons 18, 118 then once again move as unit, inward to the inner dead center.

During the above-explained coupling of the two pump pistons 18, 118 and their jointly executed delivery stroke, the mouth of the connection 53 or 253 of the control pressure chamber 52 or 252 remains open continuously so that at least approximately the same high pressure prevails in the control pressure chamber 52 or 252 as in the pump working chamber 22. In the first exemplary embodiment of the fuel injection apparatus according to FIG. 1, the high pressure prevailing in the control pressure chamber 52 exerts a powerful closing force on the second injection valve element 128 so that it opens only when there is a high pressure in the pressure chamber 40 or it remains in its closed position and the second injection openings 132 remain closed. Then only the first injection valve element 28 opens, thus opening the first injection openings 32. In the second exemplary embodiment of the fuel injection apparatus according to FIG. 2, the high pressure prevailing in the control pressure chamber 52 reduces the closing force acting on the second injection valve element 128 so that in addition to the first injection valve element 28, the second injection valve element 128 opens even when there is a relatively low pressure in the pressure chamber 40, thus opening the second injection openings 132.

Figure 6:
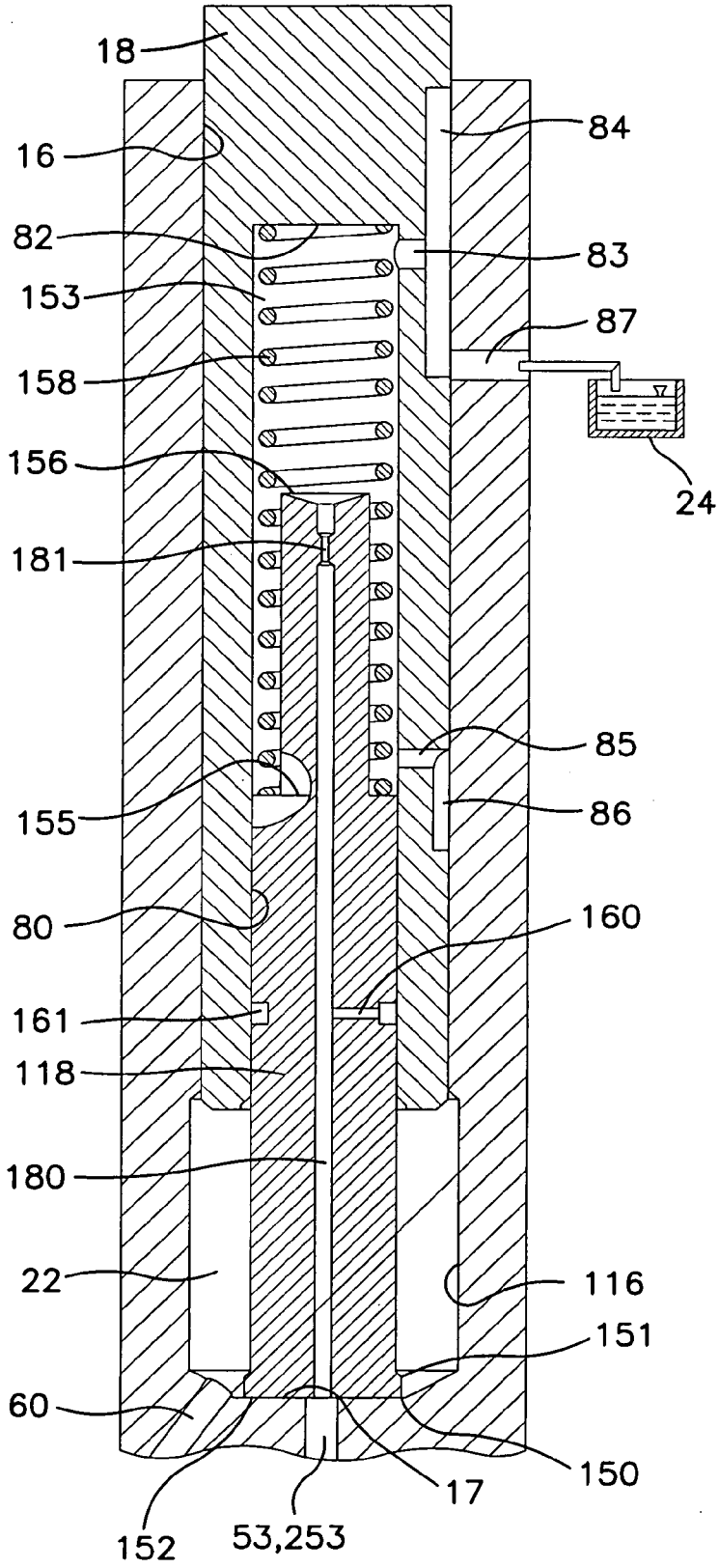
FIG. 6 shows the detail IV, with one pump piston disposed in a passive position and one pump piston disposed in an outer dead center.
Figure 7:
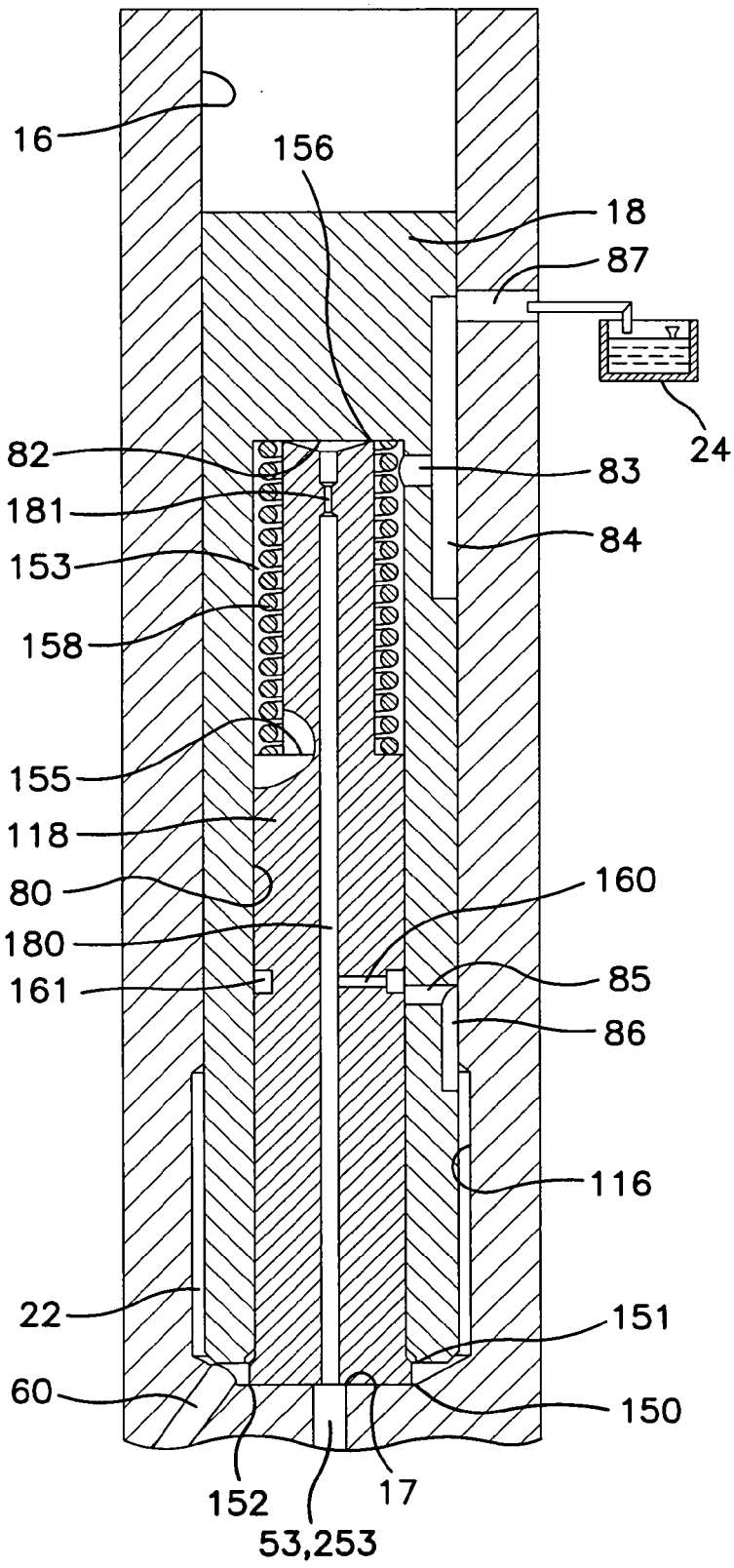
FIG. 7 shows the detail IV, with the pump pistons in the uncoupled state in an inner dead center.

In addition, the second pump piston 118 can optionally be brought into a passive position in which it does not execute a delivery stroke and only the first pump piston 18 executes a delivery stroke. This is shown in FIGS. 6 and 7. In its passive position, the second pump piston 118 rests with its sealing surface 152 in contact with the boundary 17 of the pump working chamber 22. As a result, the sealing surface 152 disconnects the through bore 180 in the second pump piston 118 from the pump working chamber 22. If a leak occurs between the sealing surface 152 and the boundary, then a small amount of fuel can escape from the pump working chamber 22 through the through bore 180 into the chamber 153 and to the low pressure region, the flow being limited by the throttle restriction 181. During the intake stroke, only the first pump piston 18 moves away from the inner dead center into the outer dead center according to FIG. 6, while the second pump piston 118 remains in its passive position. The pressure prevailing in the pump working chamber 22 exerts a force, which is oriented toward the boundary 17, on the second pump piston 118 by means of its annular shoulder 151. In addition, the spring 158 and the force exerted by the low pressure prevailing in the chamber 153 press the second pump piston 118 against the boundary 17. During the intake stroke of the first pump piston 18, the spring 158 slackens. During the delivery stroke of the first pump piston 18, only its annular end surface is effective for pressure production so that a lower maximum pressure is produced in the pump working chamber 22 than when the pump pistons 18, 118 are coupled to each other. FIG. 7 shows the pump pistons 18, 118 in the inner dead center.

If the second pump piston 118 is disposed in its passive position, then it also disconnects the control pressure chamber 52 or 252 of the fuel injection apparatus from the pump working chamber 22. As a result, high pressure no longer prevails in the control pressure chamber 52 or 252, but only the pressure of fuel supply pump 23 to which the control pressure chamber 52 or 252 is connected by means of the through bore 180 in the second pump piston 118. In the first exemplary embodiment of the fuel injection apparatus according to FIG. 1, the low pressure in the control pressure chamber 52 exerts only a slight force on the second injection valve element 128 in the closing direction so that when there is a relatively low pressure in the pressure chamber 40, this second injection valve element 128 can open in addition to the first injection valve element 28 and opens the second injection openings 132. In the second exemplary embodiment of the fuel injection apparatus according to FIG. 2, the low pressure in the control pressure chamber 252 exerts only a slight force on the second injection valve element 128 in the opening direction 29 so that the second injection valve element 128 only opens when there is a high pressure in the pressure chamber 40 or does not open at all and the second injection openings 132 remain closed.

The second pump piston 118 is brought into its passive position during the intake stroke depending on operating parameters of the engine, in particular depending on the engine speed. If the second pump piston 118 is to be brought into its passive position, then during the intake stroke, the control unit 72 closes the control valve 68 at a particular time and for a particular duration so that the connection of the pump working chamber 22 to the fuel supply pump 23 is interrupted and no fuel can flow into the pump working chamber 22. The first pump piston 18 moves away from the inner dead center to the outer dead center, driven by the return spring 19 in accordance with the shape of the cam 20. As a result, the volume of the pump working chamber 22 increases and since no fuel is flowing into it, the pressure in the pump working chamber 22 drops below the delivery pressure of the fuel supply pump 23. Consequently, only a slight pressure acts on the end surface of the second pump piston 118 in the pump working chamber 22, subjecting the second pump piston 118 to a force oriented toward the first pump piston 18, which is less than the opposing force, i.e. the sum of the force of the spring 158 and the force exerted by the low pressure prevailing in the chamber 153. The second pump piston 118 therefore moves inward until its sealing surface 152 comes into contact with the boundary 17 of the pump working chamber 22.

Then the control unit 72 opens the control valve 68 again so that the pressure in the pump working chamber 22 increases once more. When the second pump piston 118 is disposed in its passive position, though, the pressure in the pump working chamber 22 does not act on the end surface of the second pump piston 118 in the direction toward the first pump piston 18, but instead acts on the annular shoulder 151 of the second pump piston 118, i.e. toward the boundary 17, thus exerting a force on the second pump piston 118 in the direction of the boundary 17. The first pump piston 18 executes an intake stroke until reaching the outer dead center and then executes a delivery stroke until reaching the inner dead center. When the first pump piston 18 reaches the vicinity of the inner dead center, then the through bore 180 of the second pump piston 118 is connected to the pump working chamber 22 via the cross bore 160, the annular groove 161, the cross bore 85, and the longitudinal groove 86 in the first pump piston 18, which groove plunges into the section 116 of the cylinder bore 16. Then the pressure in the pump working chamber 22 acts on the end surface of the second pump piston 118 oriented toward the boundary 17 so that the sealing surface 152 of the second pump piston 118 lifts away from the boundary 17. During the subsequent intake stroke, the second pump piston 118 can be brought into its passive position by closing the control valve 68 or, if the control valve 68 continues to remain open, the second pump piston 118 can follow the intake stroke of the first pump piston 18 so that the two pump pistons 18, 118 remain coupled to each other.

As the speed of the engine increases, the speed at which the pump pistons 18, 118 move during the intake stroke and the delivery stroke also increases. If the fuel supply pump 23 generates an approximately constant delivery pressure, then the fact that the speed of the pump pistons 18, 118 increases with the engine speed causes a pressure drop in the pump working chamber 22 during the intake stroke of the pump pistons 18, 118 in comparison to the nominal delivery pressure generated by the fuel supply pump 23 and this pressure drop intensifies as the speed increases because the pump working chamber 22 cannot be refilled with fuel fast enough. The first pump piston 18 executes its intake stroke driven by the return spring 19 in accordance with the profile of the cam 20. If the pressure in the pump working chamber 22 drops sharply, then the second pump piston 118 can no longer follow the intake stroke of the first pump piston 18 since it is subjected to only a slight force oriented toward the first pump piston 18, which is less than the counteracting force, i.e. the sum of the force of the spring 158 and the force exerted by the low pressure prevailing in the chamber 153. The second pump piston 118 therefore moves toward the boundary 17 until its sealing surface 152 comes into contact with this boundary 17, thus bringing the second pump piston 118 into its passive position. Consequently, even when a certain limit speed—at which the pressure in the pump working chamber 22 drops sharply enough during the intake stroke—is reached or exceeded, it is still possible to bring the second pump piston 118 into its passive position. Preferably, however, in the vicinity of the limit speed, the control valve 68 is closed during the intake stroke as explained above in order to assure that the second pump piston 118 is disposed in its passive position. At a speed significantly higher than the limit speed, the closing of the control valve 68 can be omitted since the second pump piston 118 is then assured of being disposed in its passive position due to the pressure drop in the pump working chamber 22.

It is possible for the two pump pistons 18, 118 to be coupled to each other and execute a delivery stroke up to a predetermined limit speed. In this case, a high pressure can be produced in the pump working chamber 22 even at low engine speeds. When the predetermined limit speed is reached or exceeded, the second pump piston 118 is brought into its passive position as described above so that only the first pump piston 18 executes a delivery stroke and the pressure in the pump working chamber 22 is reduced. This makes it possible to limit the maximum pressure in the pump working chamber 22 and therefore the mechanical load on the components of the fuel injection apparatus. The limit speed above which the second pump piston 118 is disposed in its passive position can be predetermined in a fixed way or can vary depending other operating parameters of the engine. It is also possible for the second pump piston 118 to be brought into its passive position depending on operating parameters of the engine, particularly depending on the load. For example, the two pump pistons 18, 118 can be coupled to each other and execute a joint delivery stroke when the load is high, whereas when the load is low, the second pump piston 118 is disposed in its passive position and only the first pump piston 18 executes a delivery stroke. Consequently, the fuel injection occurs at a lower pressure when the load is low than it does when the load is high. The shape of the cam 20 in the region in which the intake stroke of the first pump piston 18 occurs determines the speed of the first pump piston 18 during the intake stroke. Varying the shape of the cam 20 in this region thus makes it possible to vary the speed of the first pump piston 18 during the intake stroke and therefore the pressure drop in the pump working chamber 22 and consequently also the limit speed above which the second pump piston 118 is disposed in its passive position. The pressure produced by the fuel supply pump 23 likewise determines the limit speed above which the second pump piston 118 is disposed in its passive position. The higher the pressure produced by the fuel delivery pump 23 is, the higher the limit speed will be. In order to permit a variation of the limit speed, it is also possible to vary the pressure produced by the fuel supply pump 23.

Figure 8:
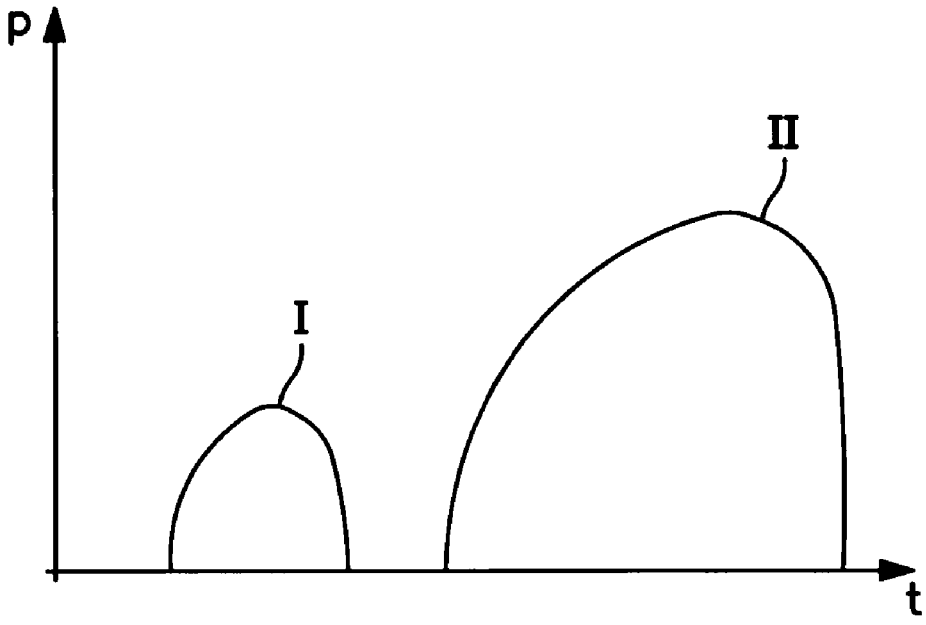
FIG. 8 shows a progression of the pressure in the injection openings of the fuel injection valve of the fuel injection apparatus over time.

The remaining function of the fuel injection apparatus will be explained below. FIG. 8 shows the course of the pressure p in the injection openings 32 of the fuel injection valve 12 over time t during an injection cycle. During the intake stroke of the pump piston 18, it is supplied with fuel from the fuel tank 24. During the delivery stroke of the pump pistons 18, 118, the fuel injection begins with a preinjection; the control unit 72 closes the control valve 68 so that the pump working chamber 22 is disconnected from the relief chamber 24. When the pressure in the pump working chamber 22 and therefore in the pressure chamber 40 of the fuel injection valve 12 is high enough for the compressive force that it exerts on the pressure shoulder 42 of the first injection valve 28 to exceed the force of the closing spring 44, the injection valve element 28 moves in the opening direction 29 and opens the at least one injection opening 32. To terminate the preinjection, the control unit opens the first control valve 68 to relieve the pressure in the pump working chamber 22. The preinjection corresponds to an injection phase labeled I in FIG. 6. It is possible for only the first injection valve element 28 to open during the preinjection, thus opening the first injection openings 32, whereas the second injection valve element 128 remains in its closed position and the second injection openings 32 remain closed.

For a subsequent main injection, which corresponds to an injection phase labeled II in FIG. 8, the control unit 72 opens the control valve 68 so that the pressure in the pump working chamber 22 increases again. As explained above, depending on operating parameters of the engine, either only the first pump piston 18 or both pump pistons 18, 118 execute a delivery stroke that determines the pressure in the pump working chamber 22. As a result, either only the first injection valve element 28 of the fuel injection valve 12 opens, thus opening the first injection openings 32, or the second injection valve element 128 also opens in a time-delayed fashion, thus opening the second injection openings 132.

In order to terminate the main injection, the control unit 72 brings the control valve 68 into its open switched position so that the pump working chamber 22 is connected to the relief chamber 24 and only a slight compressive force continues to act on the injection valve element 28 in the opening direction 29 as a result of which the force of the respective closing springs 40, 144 causes the injection valve elements 28, 128 of the fuel injection valve 12 to close.

In order for the control unit 72 to be able to control the control valve 68 for fuel injection purposes, the control unit 72 must have information as to whether both of the pump pistons 18, 118 are executing a delivery stroke or only the first pump piston 18 is executing a delivery stroke, since this results in a different pressure of the fuel injection. At the transition from the jointly executed delivery stroke of the two pump pistons 18, 118 in the coupled state to the delivery stroke solely by means of the first pump piston 18, the pressure produced in the pump working chamber 22 drops sharply from one delivery stroke to the next so that the triggering time and in particular the triggering duration of the control valve 68 by means of the control unit 72 must be correspondingly corrected in order to assure continuity of the fuel quantity injected and a proper operation of the internal combustion engine.

The foregoing relates to preferred exemplary embodiments of the invention, it being understood that other variants and embodiments thereof are possible within the spirit and scope of the invention, the latter being defined by the appended claims.

What is claimed is:

1. In a fuel injection apparatus for an internal combustion engine comprising a high-pressure fuel pump (10) and a fuel injection valve (12) connected to it for each cylinder of the engine, the high-pressure fuel pump (10) having at least one pump piston (18) that is driven into a stroke motion by the engine and delimiting a pump working chamber (22) that is supplied with fuel from a fuel tank (24), the fuel injection valve (12) having a pressure chamber (40) connected to the pump working chamber (22) and at least one first injection valve element (28), which controls at least one first injection opening (32) and, actuated by the pressure prevailing in the pressure chamber (40), can be moved in an opening direction (29) counter to a closing force in order to open the at least one injection opening (32), with a control valve (68) that at least indirectly controls a connection (66) of the pump working chamber (22) to a relief to chamber (24) and to a pressure source (23) in order to fill the pump working chamber (22) during the intake stroke of the at least one pump piston (18), the improvement wherein the high-pressure pump (10) has two pump pistons (18, 118), including a first pump piston (18) inside of which the second pump piston (118) is guided so it can slide in an at least approximately coaxial fashion, the two pump pistons (18, 118) delimiting the pump working chamber (22), wherein the first pump piston (18) is driven into a stroke motion, wherein the two pump pistons (18, 118) can optionally be coupled to each other and move as a unit during the delivery stroke or the second pump piston (118) can be fixed in a passive position so only the first pump piston (18) executes a delivery stroke, wherein the fuel injection valve (12) has a second injection valve element (128), which is guided in a sliding fashion inside the hollow first injection valve element (28), controls the at least one second injection opening (132), and can be moved by the pressure prevailing in the pressure chamber (40) in an opening direction (29) counter to a closing force, wherein the second injection valve element (128) is at least indirectly acted on by the pressure prevailing in a fuel-filled control pressure chamber (52; 252), and wherein the control pressure chamber (52; 252) has a connection (53; 253) to the pump working chamber (22) controlled by the second pump piston (118), wherein the control pressure chamber (52; 252) is disconnected from the pump working chamber (22) when the second pump piston (118) is disposed in its passive position.

2. The fuel injection apparatus according to claim 1, wherein the pressure prevailing in the control pressure chamber (52) at least indirectly acts on the second injection valve element (128) in a closing direction.

3. The fuel injection apparatus according to claim 1, wherein the pressure prevailing in the control pressure chamber (252) at least indirectly acts on the second injection valve element (128) in the opening direction (29).

4. The fuel injection apparatus according to claim 1, wherein the second pump piston (118) is disposed in its passive position, with one end against a boundary (17) of the pump working chamber (22), in the vicinity of an inner dead center of the stroke motion of the pump pistons (18, 118) in which the pump pistons (18, 118) are disposed at the end of a delivery stroke and at the beginning of an intake stroke.

5. The fuel injection apparatus according to claim 1, wherein the first pump piston (18) has a blind bore (80), which opens toward its end surface that delimits the pump working chamber (22) and in which the second pump piston (118) is guided in a sliding fashion.

6. The fuel injection apparatus according to claim 5, wherein inside the blind bore (80), the second pump piston (118) delimits a chamber (153) that is connected to a low-pressure region.

7. The fuel injection apparatus according to claim 5, wherein when the two pump pistons (18, 118) are in the coupled state, one end of the second pump piston (118) rests against the bottom (82) of the blind bore (80) of the first pump piston (18).

8. The fuel injection apparatus according to claim 6, wherein when the two pump pistons (18, 118) are in the coupled state, one end of the second pump piston (118) rests against the bottom (82) of the blind bore (80) of the first pump piston (18).

9. The fuel injection apparatus according to claim 7, wherein the second pump piston (118) has a through conduit (180), which can connect the pump working chamber (22) to the chamber (153) and contains at least one throttle restriction (181).

10. The fuel injection apparatus according to claim 8, wherein the second pump piston (118) has a through conduit (180), which can connect the pump working chamber (22) to the chamber (153) and contains at least one throttle restriction (181).

11. The fuel injection apparatus according to claim 9, wherein the end of the second pump piston (118) oriented toward the bottom (82) of the blind bore (80) has a sealing surface (156) that closes the mouth of the through conduit (180) in relation to the chamber (153) when the sealing surface (156) of the second pump piston (118) is resting against the bottom (82) of the blind bore (80) so that the chamber (153) is disconnected from the through conduit (180).

12. The fuel injection apparatus according to claim 10, wherein the end of the second pump piston (118) oriented toward the bottom (82) of the blind bore (80) has a sealing surface (156) that closes the mouth of the through conduit (180) in relation to the chamber (153) when the sealing surface (156) of the second pump piston (118) is resting against the bottom (82) of the blind bore (80) so that the chamber (153) is disconnected from the through conduit (180).

13. The fuel injection apparatus according to claim 5, further comprising a spring (158) clamped between the first pump piston (18) and the second pump piston (118), the spring (158) urging the second pump piston (118) out from the blind bore (80).

14. The fuel injection apparatus according to claim 13, wherein the spring (158) is clamped between the bottom (82) of the blind bore (80) and an annular shoulder (155) on the second pump piston (118) that is formed by a cross-sectional reduction.

15. The fuel injection apparatus according to claim 4, wherein the second pump piston (118) has a through conduit (180), which can connect the pump working chamber (22) to the chamber (153) and contains at least one throttle restriction (181), and wherein the end of the second pump piston (118) oriented toward the boundary (17) of the pump working chamber (22) is provided with a sealing surface (152) that closes the mouth of the through conduit (180) in relation to the pump working chamber (22) when the sealing surface (152) of the second pump piston (118) is resting against the boundary (17) of the pump working chamber (22) so that the pump working chamber (22) is disconnected from the through conduit (180).

16. The fuel injection apparatus according to claim 9, wherein the through conduit (180) of the second pump piston (118) has a connection (85, 86, 160, 161) to the pump working chamber (22) controlled by the first pump piston (18), that when the first pump piston (18) is disposed in the vicinity of the inner dead center, the through conduit (180) is connected to the pump working chamber (22), and that when the first pump piston (18) is disposed outside the vicinity of the inner dead center, the through conduit (180) is disconnected from the pump working chamber (22).

17. The fuel injection apparatus according to claim 4, wherein, close to its end that comes into contact with the boundary (17) of the pump working chamber (22), the second pump piston (118) has an annular surface (151), which is oriented away from the boundary (17) and is acted on by the pressure prevailing in the pump working chamber (22), and a force oriented toward the boundary (17) is thus exerted on the second pump piston (118).

18. The fuel injection apparatus according to claim 11, wherein, close to its end that comes into contact with the boundary (17) of the pump working chamber (22), the second pump piston (118) has an annular surface (151), which is oriented away from the boundary (17) and is acted on by the pressure prevailing in the pump working chamber (22), and a force oriented toward the boundary (17) is thus exerted on the second pump piston (118).

19. The fuel injection apparatus according to claim 1, wherein, in order to place the second pump piston (118) into its passive position, the control valve (68) is closed during the intake stroke of the pump pistons (18, 118), thus interrupting the connection of the pump working chamber (22) to the pressure source (23) so that a pressure drop occurs in the pump working chamber (22) as a result of which the second pump piston (118) is uncoupled from the first pump piston (18), and that the control valve (68) is subsequently reopened during the intake stroke so that the pressure prevailing in the pump working chamber (22) moves the second pump piston (118) into its passive position.

20. The fuel injection apparatus according to claim 1, wherein, during the intake stroke of the pump pistons (18, 118), a pressure drop occurs in the pump working chamber (22), which intensifies as the engine speed increases, and that when a predetermined limit speed is reached or exceeded, the pressure in the pump working chamber (22) drops sharply so that as a result, the second pump piston (118) is uncoupled from the first pump piston (18) and is brought into its passive position.

* * * * *